US008141201B2

(12) United States Patent
Yokote et al.

(10) Patent No.: US 8,141,201 B2
(45) Date of Patent: Mar. 27, 2012

(54) ELECTRIC FAN

(75) Inventors: Shizuka Yokote, Osaka (JP); Keigo Matsumoto, Fukui (JP)

(73) Assignee: Panasonic Corporation, Osaka (JP)

( * ) Notice: Subject to any disclaimer, the term of this patent is extended or adjusted under 35 U.S.C. 154(b) by 340 days.

(21) Appl. No.: 12/370,396

(22) Filed: Feb. 12, 2009

(65) Prior Publication Data

US 2009/0205154 A1 Aug. 20, 2009

(30) Foreign Application Priority Data

Feb. 14, 2008 (JP) ..... 2008-032864

(51) Int. Cl.
*A47L 9/00* (2006.01)

(52) U.S. Cl. ..... 15/347; 15/300.1; 15/331; 15/346; 15/361; 15/421

(58) Field of Classification Search ..... 15/300.1, 15/331, 346, 347, 361, 421
See application file for complete search history.

(56) References Cited

U.S. PATENT DOCUMENTS 3,257,681 A * 6/1966 Miller ..... 15/331

FOREIGN PATENT DOCUMENTS

| | | |
|---|---|---|
| JP | 3-138495 | 6/1991 |
| JP | 3-264701 | 11/1991 |
| JP | 9-14192 | 1/1997 |
| JP | 9-511557 | 11/1997 |
| JP | 2000-110783 | 4/2000 |

* cited by examiner

*Primary Examiner* — Robert Scruggs
(74) *Attorney, Agent, or Firm* — Hamre, Schumann, Mueller & Larson, P.C.

(57) ABSTRACT

A side plate of an impeller is formed so that the height thereof is lowered gradually from an edge portion of a central opening portion toward a circumferential portion. When the distance from the edge portion of the central opening portion to the circumferential portion, in a direction perpendicular to the output shaft, is taken as L, the distance from the edge portion of the central opening portion to the circumferential portion, in the direction of the output shaft, is taken as H, a point on the side plate away from the edge portion of the central opening portion by 0.1×L in the direction perpendicular to the output shaft is taken as P, and the distance from the edge portion of the central opening portion to the point P in the direction of the output shaft is taken as ΔH, $\Delta H/H \geqq 0.4$ is satisfied. With this configuration, the formation of a vortex flow in the flow channel inside the impeller from the air inlet to the air outlet is reduced, and, thus, air blowing efficiency is improved.

5 Claims, 9 Drawing Sheets

ELECTRIC FAN

BACKGROUND OF THE INVENTION

1. Field of the Invention

The present invention relates to an electric fan, preferably used in an electric vacuum cleaner and the like. The present invention relates also to an electric vacuum cleaner including an electric fan.

2. Description of Related Art

JP H9(1997)-14192A discloses an electric fan that includes an impeller rotated by a motor and is used in the above-mentioned technical fields. In this electric fan, when the total area of a virtual columnar face inside the impeller, formed by connecting center-side ends of a plurality of blades inside the impeller, is taken as S1, and the total area of an air inlet of the impeller is taken as S0, S1/S0 is set to 1.0 to 1.4. In a cross section including a rotational axis, when the radius of curvature in the vicinity of a central opening portion of a side plate of the impeller is taken as R, and the width of the center-side ends of the blades in the impeller in the direction of the rotational axis is taken as b, R/b is set to 0.6 to 0.9. It is stated that, with this configuration, air blowing efficiency can be kept high.

FIG. 16 is a partial cross-sectional view along a face including a rotational axis of an impeller 130 configuring the above-described conventional electric fan. When the impeller 130 rotates about a rotational axis 130*a*, a flow of air (air flow) 135 is formed that flows in from a central opening portion (air inlet) 132*a* of a side plate 132 and flows out from an air outlet 139 between a circumferential portion 132*b* of the side plate 132 and a circumferential portion 131*b* of a main plate 131.

However, as seen from FIG. 16, the conventional electric fan has a problem in that air blowing efficiency is lowered by a turbulent flow, referred to as a vortex flow 134, formed in the flow channel in the vicinity of the central opening portion 132*a* of the side plate 132.

SUMMARY OF THE INVENTION

The present invention is to solve the above-described problem, and it is an object thereof to provide an electric fan in which the air blowing efficiency is improved by reducing formation of a vortex flow in the flow channel of air flows inside an impeller from an air inlet to an air outlet. The present invention relates also to an electric vacuum cleaner including an electric fan in which the air blowing efficiency is improved.

The present invention is directed to an electric fan, comprising: a motor that has a rotor; and an impeller that includes a main plate attached to an output shaft of the rotor and having a circular circumferential portion, a side plate disposed coaxially with the main plate with a predetermined spacing therebetween, having a central opening portion that allows an air flow to flow in, and having a circular circumferential portion, and a plurality of blades arranged between the main plate and the side plate. The side plate of the impeller is formed so that the height thereof is lowered gradually from an edge portion of the central opening portion toward the circumferential portion. When the distance from the edge portion of the central opening portion to the circumferential portion of the side plate, in a direction perpendicular to the output shaft, is taken as L, the distance from the edge portion of the central opening portion to the circumferential portion of the side plate, in the direction of the output shaft, is taken as H, a point on the side plate away from the edge portion of the central opening portion by 0.1×L in the direction perpendicular to the output shaft is taken as P, and the distance from the edge portion of the central opening portion to the point P in the direction of the output shaft is taken as ΔH, $\Delta H/H \geqq 0.4$ is satisfied.

An electric vacuum cleaner according to the present invention includes the above-described electric fan according to the present invention.

DESCRIPTION OF THE PREFERRED EMBODIMENTS

Figure 1:
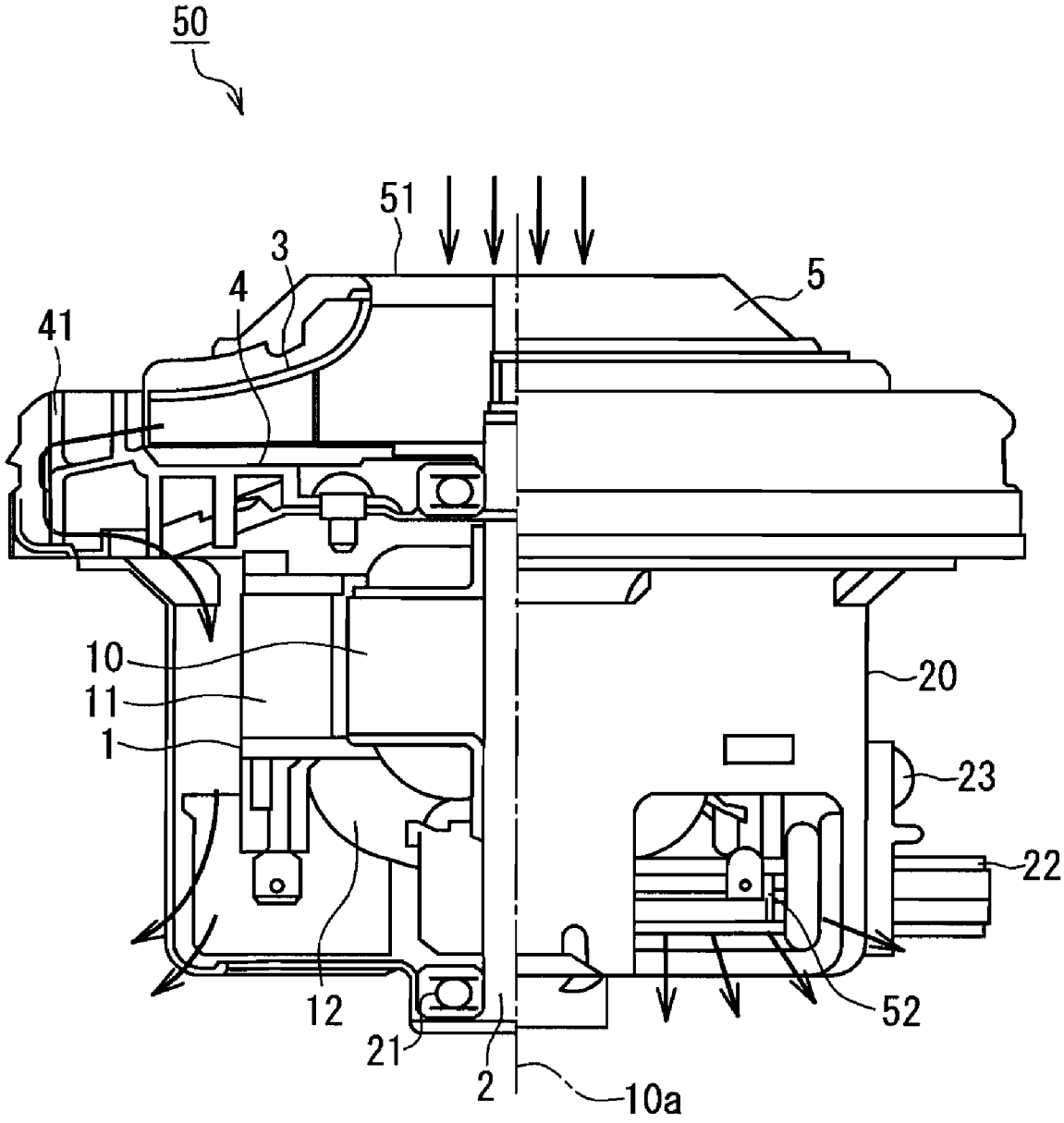
FIG. 1 is a half cross-sectional view showing an electric fan according to an embodiment of the present invention.

According to the present invention, the ratio ΔH/H satisfies $\Delta H/H \geqq 0.4$, and, thus formation of a vortex flow in the flow channel of air flows inside an impeller from an air inlet to an air outlet can be reduced, and, thus, the air blowing efficiency can be improved.

In the electric fan of the present invention, it is preferable that a cylindrical portion coaxial with the output shaft is formed in the central opening portion of the side plate.

Furthermore, it is preferable that, when the total area of the central opening portion of the side plate is taken as S1, the total area of a portion between the main plate and the side plate of a virtual columnar face that passes through outer ends of the plurality of blades and whose central axis matches the output shaft is taken as S2, and the total area of a portion between the main plate and the side plate of a virtual columnar face that is formed in a range between the edge portion of the central opening portion of the side plate and the outer ends of the plurality of blades and whose central axis matches the output shaft is taken as S3, S1<S3<S2 is satisfied.

Hereinafter, preferred embodiments of the present invention will be described with reference to the drawings. It will be appreciated that the present invention is not limited to the following embodiments. The drawings are conceptually shown to facilitate understanding of the present invention, and the size and the size ratio of portions in the drawings may not match the actual ones.

FIG. 1 is a half cross-sectional view showing an electric fan 50 according to an embodiment of the present invention.

The electric fan 50 according to this embodiment includes a motor 1 that has a rotor 10 rotatably held by a bracket 20, an impeller 3 that is attached to an output shaft 2 of the rotor 10, an air guide 4 that defines an air path in the outer circumference and the lower portion of the impeller 3, and a fan case 5 that accommodates the impeller 3 and the air guide 4 and is attached airtightly to the outer circumference of the motor 1.

The field magnet of the motor 1 is formed by a field magnet wire 12 wound around a field magnet core 11. The rotor 10 is supported rotatably about a rotational axis 10*a* by bearings 21 situated at both ends of the output shaft 2. The field magnet is fixed to the bracket 20. Furthermore, a pair of carbon brushes (not shown) are fixed via a brush holder 22 to a screw 23 of the bracket 20.

An air inlet 51 is formed at the central portion of the fan case 5. A plurality of air outlets 52 are formed at the outer circumference of the bracket 20.

The air guide 4 includes a plurality of stationary blades 41. Furthermore, volute chambers that guide air discharged via the outer circumference of the impeller 3 are formed between the adjacent stationary blades 41.

Figure 2:
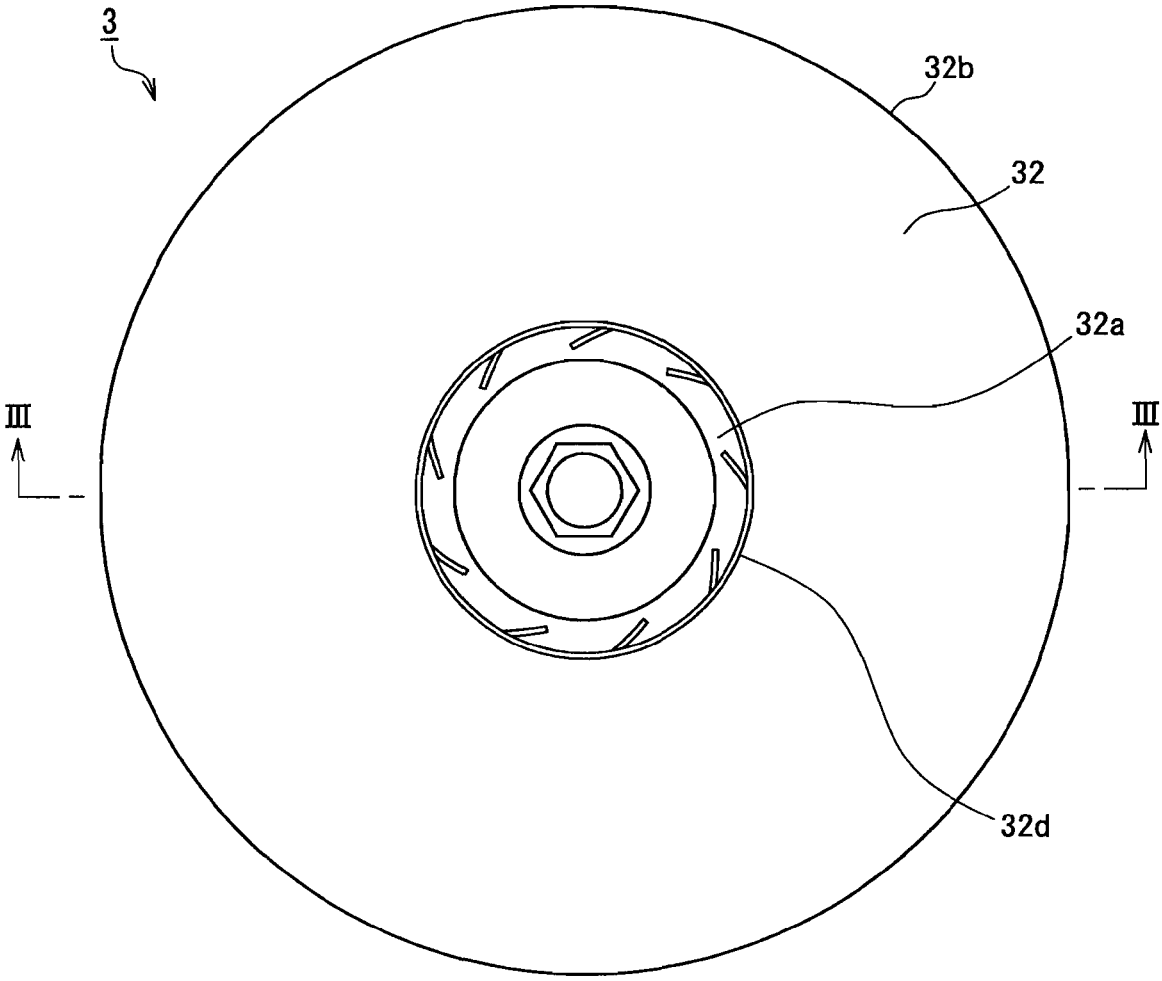
FIG. 2 is a plan view showing an impeller mounted on the electric fan according to an embodiment of the present invention.
Figure 3:
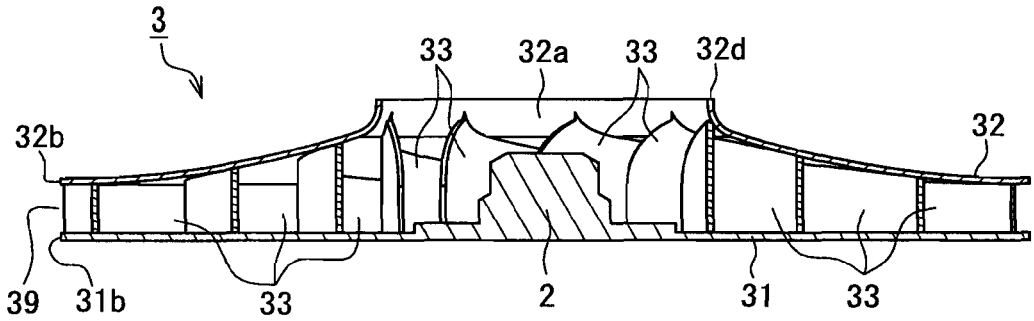
FIG. 3 is a cross-sectional view of the impeller taken along the line III-III in FIG. 2.
Figure 4:
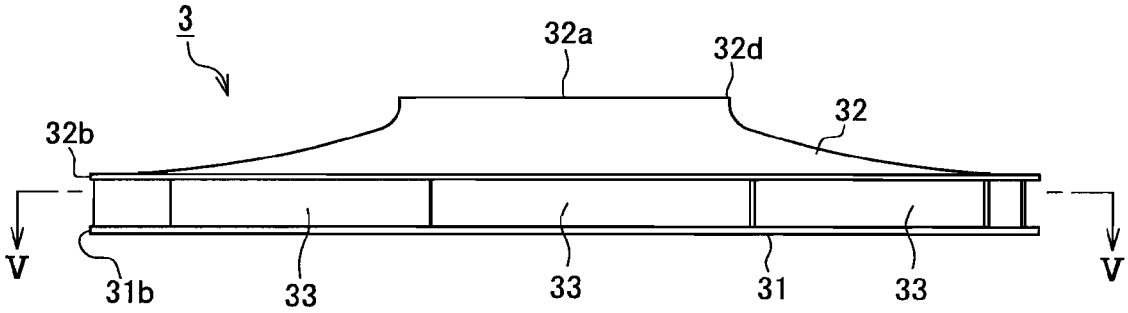
FIG. 4 is a side view showing the impeller mounted on the electric fan according to an embodiment of the present invention.
Figure 5:
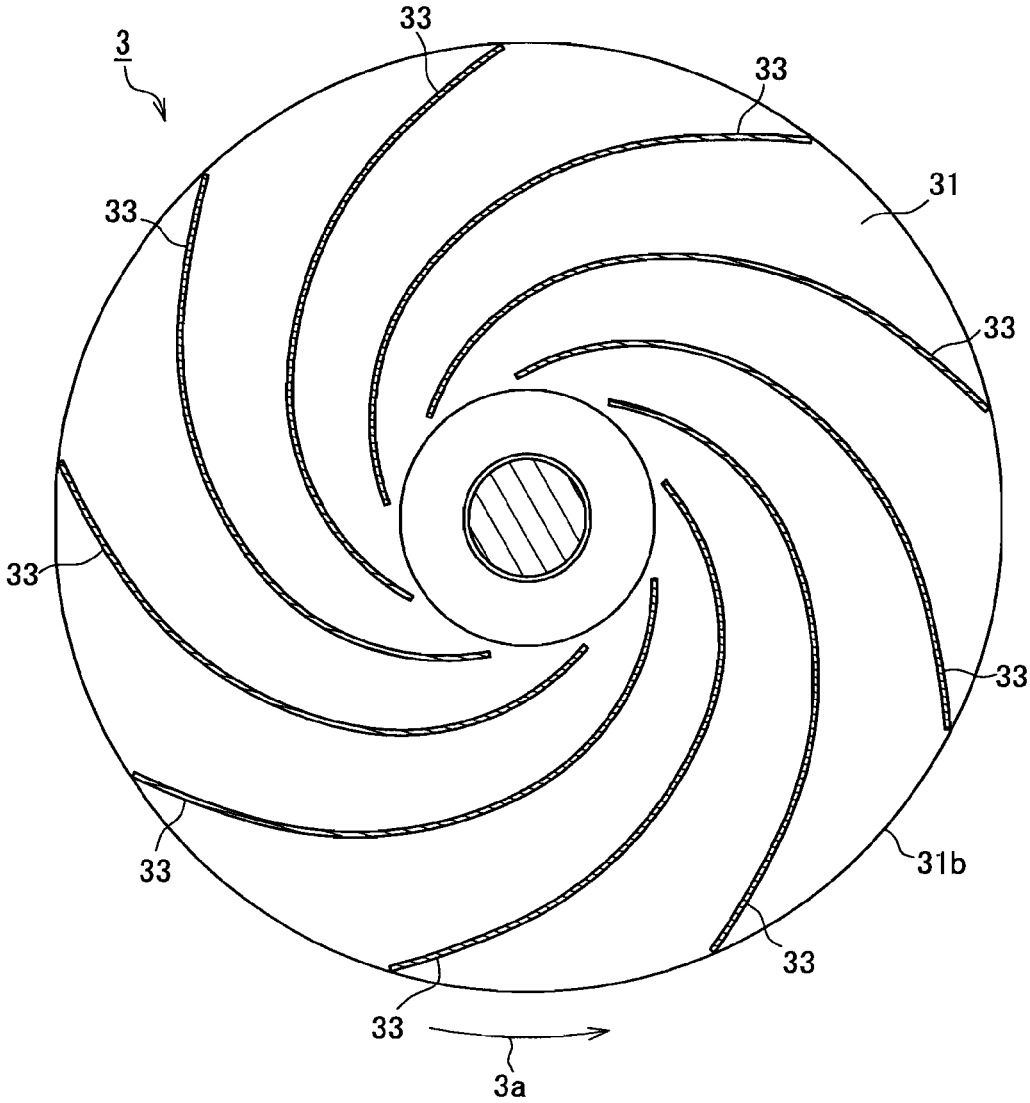
FIG. 5 is a cross-sectional view of the impeller taken along the line V-V in FIG. 4.
Figure 6:
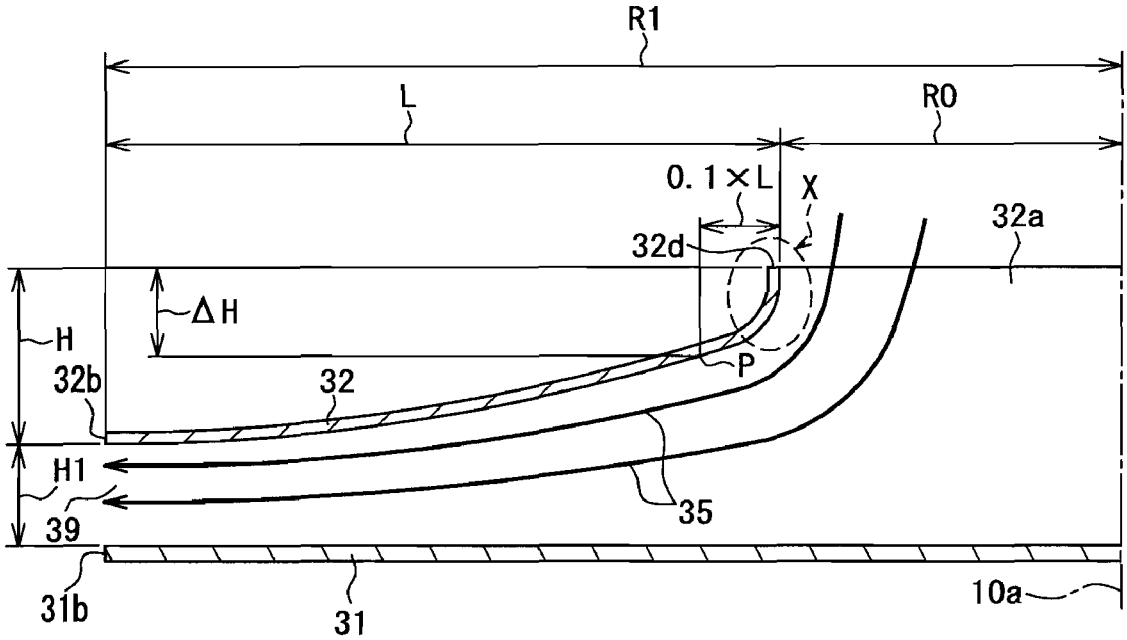
FIG. 6 is a partial cross-sectional view showing air flows inside the impeller.

FIG. 2 is a plan view of the impeller 3. FIG. 3 is a cross-sectional view of the impeller 3 taken along line III-III in FIG. 2. FIG. 4 is a side view of the impeller 3. FIG. 5 is a cross-sectional view of the impeller 3 taken along line V-V in FIG. 4. FIG. 6 is a partial cross-sectional view along a face including the rotational axis 10*a*, showing air flows inside the impeller 3.

The impeller 3 includes a main plate 31 that is coaxially attached to the output shaft 2 of the rotor 10, a side plate 32 that is disposed coaxially with the main plate 31 with a predetermined spacing therebetween, and a plurality of blades 33 that are arranged at equal intervals in the circumferential direction between the main plate 31 and the side plate 32. A circumferential portion 31*b* of the main plate 31 viewed along the rotational axis 10*a* is in the shape of a circle. A central opening portion 32*a* that allows air flows to flow in is defined at the center of the side plate 32. A circumferential portion 32*b* of the side plate 32 viewed along the rotational axis 10*a* is in the shape of a circle. An edge portion 32*d* of the central opening portion 32*a* viewed along the rotational axis 10*a* is in the shape of a circle. In the direction (the radial direction) perpendicular to the rotational axis 10*a* (or the output shaft 2), the positions of the circumferential portion 31*b* of the main plate 31, the circumferential portion 32*b* of the side plate 32, and the outer ends (portions farthest from the rotational axis 10*a*) of the plurality of blades 33 are matched. In FIG. 5, the arrow 3*a* indicates the direction in which the impeller 3 rotates. When the impeller 3 rotates in the rotational direction 3*a*, air flows in from the central opening portion (air inlet) 32*a* and flows out from an air outlet 39 between the circumferential portion 32*b* of the side plate 32 and the circumferential portion 31*b* of the main plate 31.

As shown in FIG. 6, a face that defines an air flow channel of the side plate 32 of the impeller 3 (that is, a face opposing the main plate 31, this face is hereinafter referred to as an 'inner face') is formed so that the height (the position in the direction of the output shaft 2) is lowered gradually (that is, the inner face is positioned closer to the main plate 31) from the edge portion 32*d* of the central opening portion 32*a* toward the circumferential portion 32*b*.

Moreover, the curve of the inner face of the side plate 32 satisfies the following condition. As shown in FIG. 6, when the distance from the edge portion 32*d* of the central opening portion 32*a* to the circumferential portion 32*b* of the side plate 32, in the direction perpendicular to the output shaft 2 (the radial direction), is taken as L, the distance from the edge portion 32*d* of the central opening portion 32*a* to the circumferential portion 32*b* of the side plate 32, in the direction of the output shaft 2 (the direction of the rotational axis 1*a*), is taken as H, a point on the inner face of the side plate 32 away from the edge portion 32*d* of the central opening portion 32*a* by 0.1×L in the direction perpendicular to the output shaft 2 is taken as P, and the distance from the edge portion 32*d* of the central opening portion 32*a* to the point P in the direction of the output shaft 2 is taken as ΔH, $\Delta H/H \geqq 0.4$ is satisfied. The reason for this will be described below.

Figure 7:
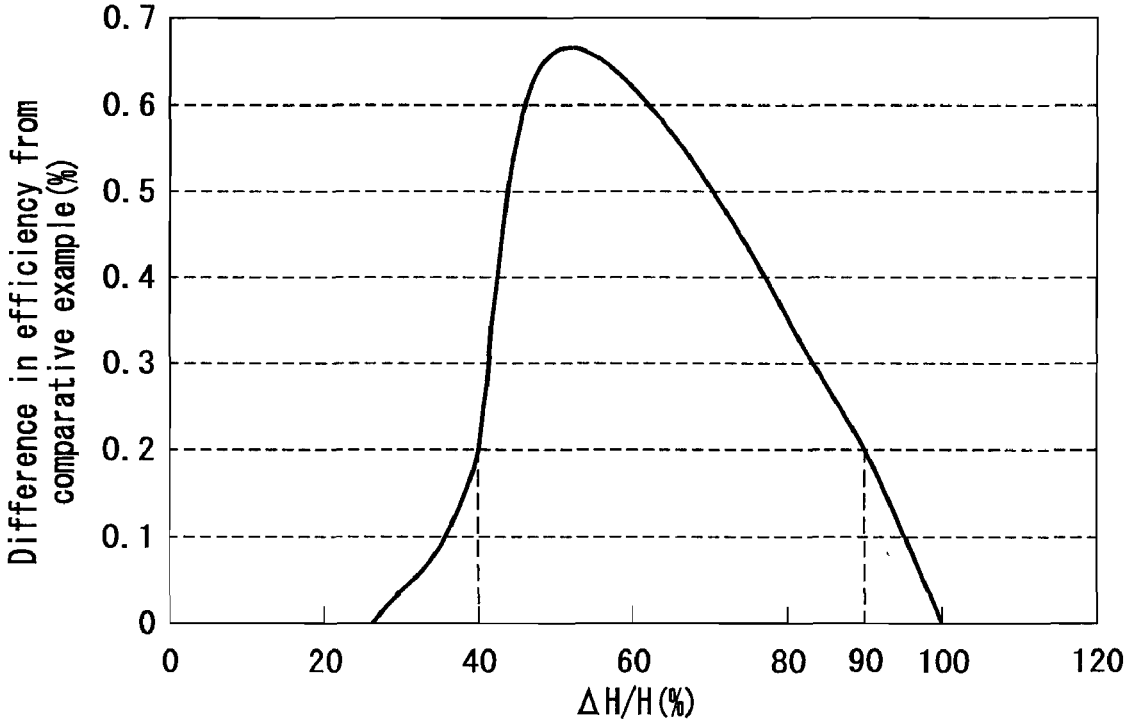
FIG. 7 is a graph showing the relationship between the height of a point P in the vicinity of a central opening portion of an inner face of a side plate and the difference in efficiency from an electric fan of a comparative example.

FIG. 7 is a graph showing the calculated results of the change in efficiency in comparison with an electric fan of a comparative example, in the case where the height of the point P in the vicinity of the central opening portion 32*a* of the inner face of the side plate 32 is changed. In FIG. 7, the horizontal axis indicates a ratio ((ΔH/H)×100(%)) of the distance ΔH from the edge portion 32*d* of the central opening portion 32*a* to the point P on the inner face of the side plate 32, with respect to the distance H from the edge portion 32*d* of the central opening portion 32*a* to the circumferential portion 32*b*. The vertical axis indicates a difference in efficiency from the electric fan of the comparative example. Here, in the 'electric fan of the comparative example', the ratio ΔH/H is 25%. That is to say, FIG. 7 shows a change in the efficiency of the electric fan with respect to a change in the height of the point P on the inner face of the side plate 32 in the direction of the output shaft 2, using, as a reference, the case in which the ratio ΔH/H is 25%.

Here, the efficiency of the electric fan is defined as:

(Efficiency)=(fan output)/(motor input).

In the equation, (fan output)=(air volume)×(static pressure), and (motor input)=(current)×(voltage)×(power factor).

As seen from FIG. 7, the ratio ΔH/H of the distance (sagging amount at the point P) ΔH from the edge portion 32*d* to the point P on the inner face of the side plate 32 positioned in the vicinity of the central opening portion 32*a*, with respect to the distance (total sagging amount) H from the edge portion 32*d* to the circumferential portion 32*b* significantly affects the efficiency of the electric fan.

More specifically, if the ratio ΔH/H of the sagging amount at the point P with respect to the total sagging amount of the inner face of the side plate 32 is less than 40%, the difference in efficiency from the electric fan of the comparative example is less than 0.2%. Here, a difference in efficiency of '0.2%' is a typical measuring limit when measuring the characteristics of an electric fan.

On the other hand, if the ratio ΔH/H is 40% or more, the difference in efficiency from the electric fan of the comparative example is 0.2% or more, that is, the efficiency significantly is improved.

Figure 8:
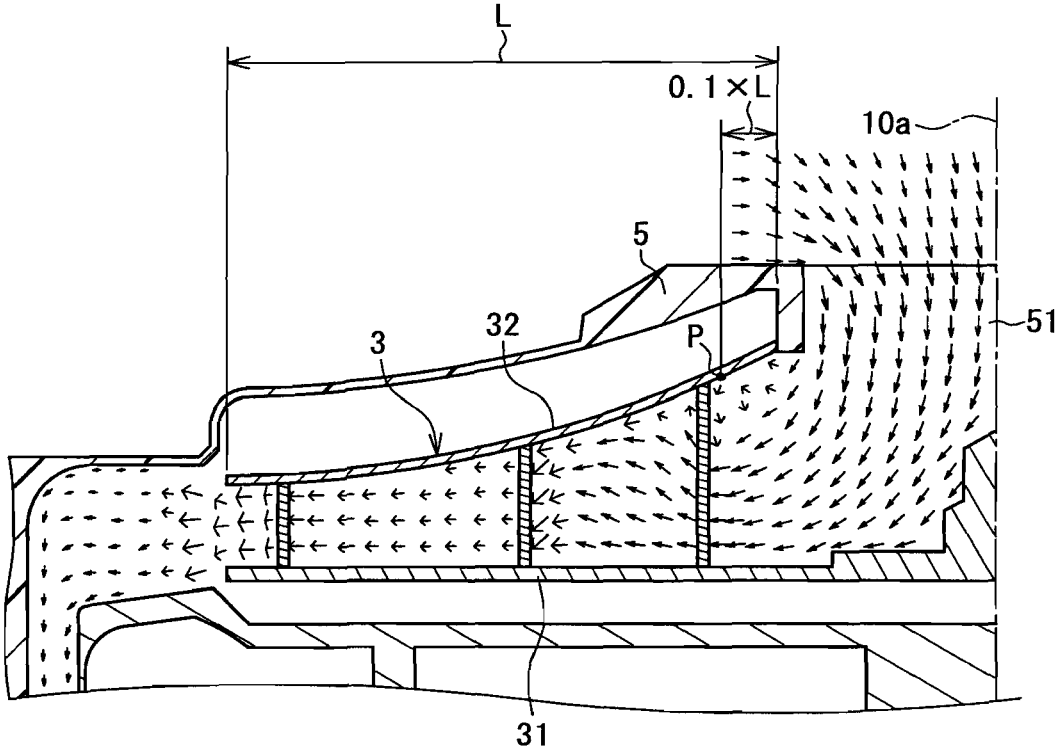
FIG. 8 is a view showing the results obtained by analyzing the flow of air inside the flow channel of the impeller in a comparative example in which the ratio ΔH/H is 25%.
Figure 9:
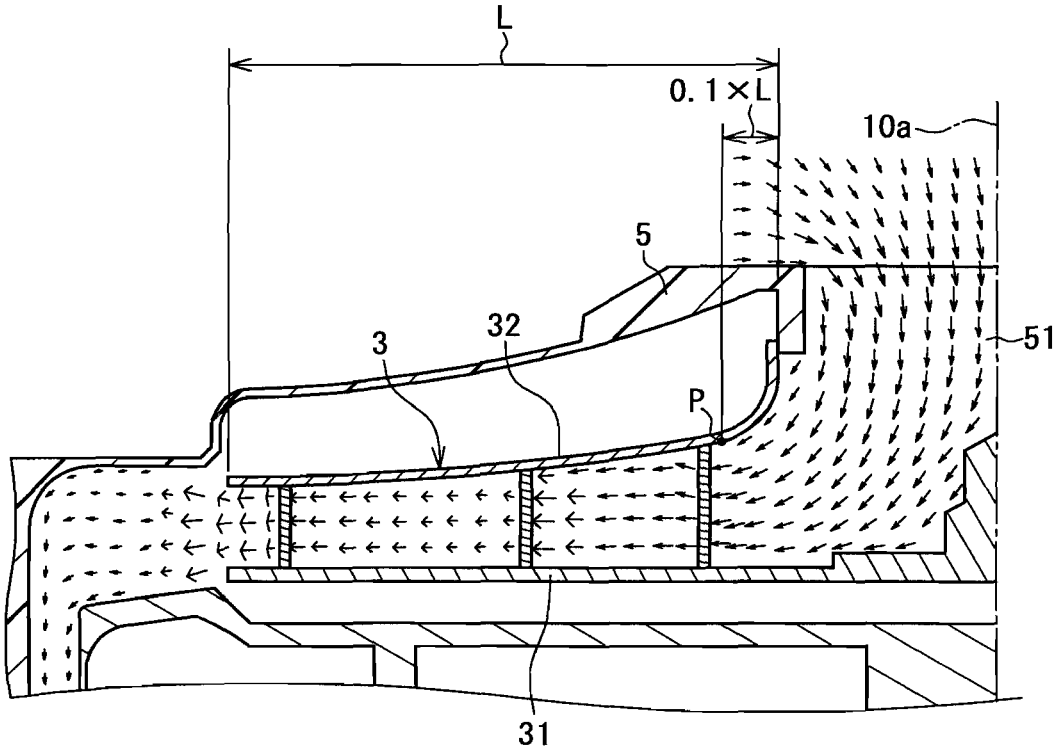
FIG. 9 is a view showing the results obtained by analyzing the flow of air inside the flow channel of the impeller according to an embodiment of the present invention in which the ratio ΔH/H is 40%.

FIGS. 8 and 9 show calculated results of the flow of air inside the flow channel of the impeller 3. FIG. 8 shows the flow of air inside the impeller 3 of the electric fan of the comparative example in which the ratio ΔH/H is 25%. FIG. 9 shows the flow of air inside the impeller 3 according to an embodiment of the present invention in which the ratio ΔH/H is 40%. These views are cross-sectional views of the impeller 3, including the rotational axis 10*a*. The arrows in the views are the three-dimensional flow directions of air at each point on the cross sections, projected onto the cross sections. The length of the arrows does not match the flow speed.

Figure 16:
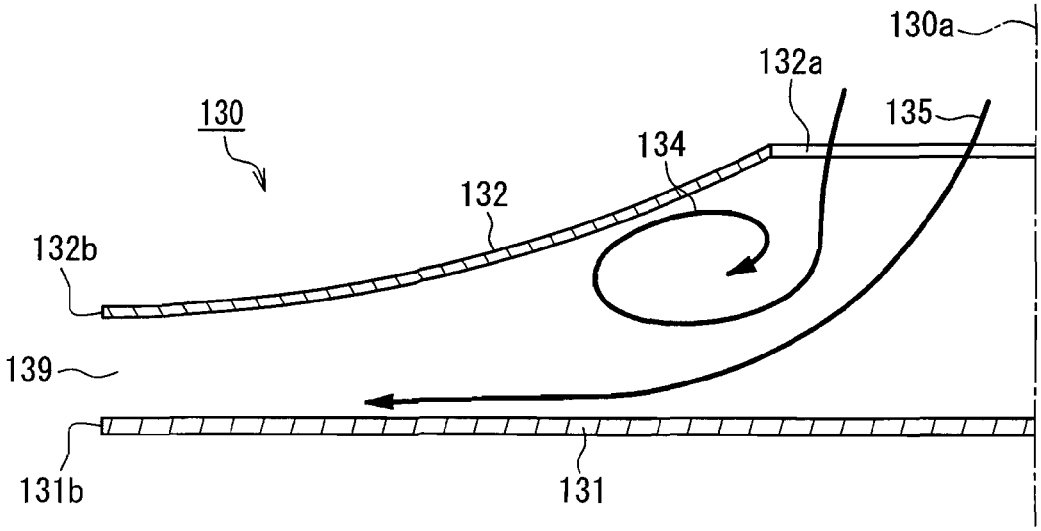
FIG. 16 PRIOR ART
FIG. 16 is a partial cross-sectional view showing an enlarged part of the impeller configuring a conventional electric fan.

While FIG. 8 shows that an air vortex flow is formed in the vicinity of the point P, FIG. 9 shows that this sort of air vortex flow is not formed in the vicinity of the point P. The inventors of the present invention focused on the fact that, in the conventional electric fan shown in FIG. 16, an air vortex flow is formed in the vicinity of the point P in a flow channel inside the impeller as in the electric fan of the comparative example shown in FIG. 8. Furthermore, the inventors found that, if the height of the inner face of the side plate 32 at the point P is lowered (that is, if the ΔH is increased) as shown in FIG. 9, formation of the above-described air vortex flow can be suppressed, and, thus air blowing efficiency is improved significantly as shown in FIG. 7.

Accordingly, the impeller 3 of the electric fan according to the present invention is configured so that the ratio ΔH/H of the sagging amount ΔH at the point P with respect to the total sagging amount H of the inner face of the side plate 32 satisfies $\Delta H/H \geqq 0.4$. With this configuration, formation of an air vortex flow in the flow channel of air flows inside the impeller 3 from the air inlet (central opening portion) 32*a* to the air outlet 39 is reduced, and, thus, air blowing efficiency can be improved.

Conversely, as shown in FIG. 7, if the ratio ΔH/H is more than 90%, the difference in efficiency from the electric fan of the comparative example is less than 0.2%. The reason for this seems to be that, since the cross-sectional area of a flow channel of an air flow suddenly becomes small in the vicinity of the edge portion 32*d* of the central opening portion 32*a*, the average flow speed of the air flows suddenly increases.

Accordingly, the ratio ΔH/H preferably satisfies $0.4 \leqq \Delta H/H \leqq 0.9$.

In the case where the electric fan of the present invention is used in an electric vacuum cleaner and the like, when the radius of the central opening portion 32*a* (the distance from the rotational axis 10*a* to the edge portion 32*d*) is taken as R0, and the radius of the impeller 3 (the distance from the rotational axis 10*a* to the outer ends of the plurality of blades 33) is taken as R1, as shown in FIG. 6, $R0/R1 < 0.5$ preferably is satisfied. Furthermore, when the distance between the circumferential portion 31*b* of the main plate 31 and the circumferential portion 32*b* of the side plate 32 in the direction of the rotational axis 10*a* is taken as H1, $H1 < H$ preferably is satisfied. Furthermore, as shown in FIG. 5, the plurality of blades 33 preferably are so-called 'backward curved blades' that have curved faces protruding toward the rotational direction 3*a* of the impeller 3.

Figure 10:
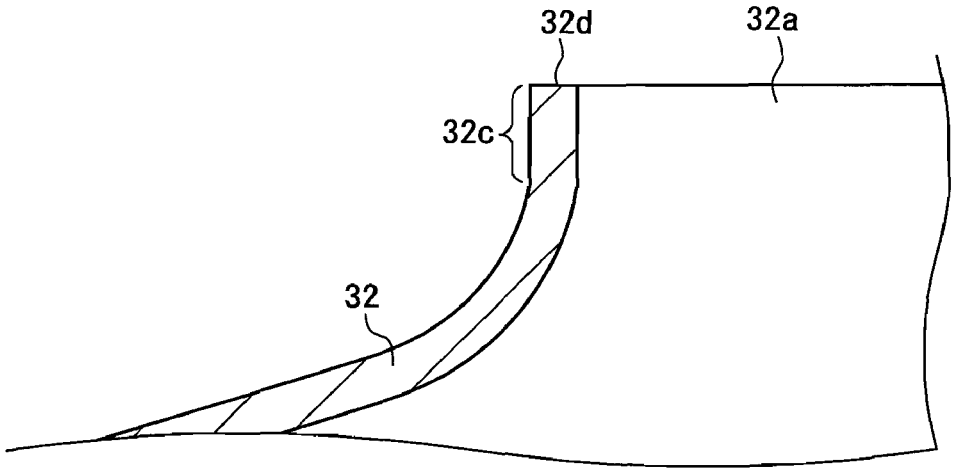
FIG. 10 is an enlarged cross-sectional view of an X portion in FIG. 6.

A cylindrical portion coaxial with the output shaft 2 preferably is formed in the central opening portion 32*a* of the side plate 32. FIG. 10 is an enlarged cross-sectional view of an X portion in FIG. 6, and shows that a cylindrical straight portion 32*c* is formed in the central opening portion 32*a*. If there is a curved portion in the wall face defining a flow channel in the vicinity of the boundary between the air inlet 51 of the fan case 5 and the central opening portion 32*a* of the side plate 32, this curved portion disturbs the air flows. Thus, in this embodiment, the straight portion 32*c* coaxial with the output shaft 2 is formed in the central opening portion 32*a* of the side plate 32, and, thus, the wall face defining a flow channel at the boundary portion between the fan case 5 and the side plate 32 is formed into a smoothly curved face. With this configuration, air flows are not likely to be disturbed. If the cylindrical straight portion 32*c* is formed in the central opening portion 32*a* in this manner, air flows that have flowed in from the air inlet 51 of the fan case 5 can be allowed to flow smoothly along the inner face of the side plate 32. Here, in a case where the straight portion 32*c* is formed, its upper end functions as the edge portion 32*d* of the central opening portion 32*a*.

When the total area of the central opening portion 32*a* of the side plate 32 is taken as S1, the total area of a portion between the main plate 31 and the side plate 32 of a virtual columnar face that passes through the outer ends of the plurality of blades 33 and whose central axis matches the output shaft 2 is taken as S2, and the total area of a portion between the main plate 31 and the side plate 32 of a virtual columnar face that is formed in a range between the edge portion 32*d* of the central opening portion 32*a* of the side plate 32 and the outer ends of the plurality of blades 33 and whose central axis matches the output shaft 2 is taken as S3, $S1 < S3 < S2$ preferably is satisfied.

With this configuration, air smoothly flows in a flow channel inside the impeller 3 from the air inlet (central opening portion) 32*a* to the air outlet 39. The reason for this will be described below.

Figure 11:
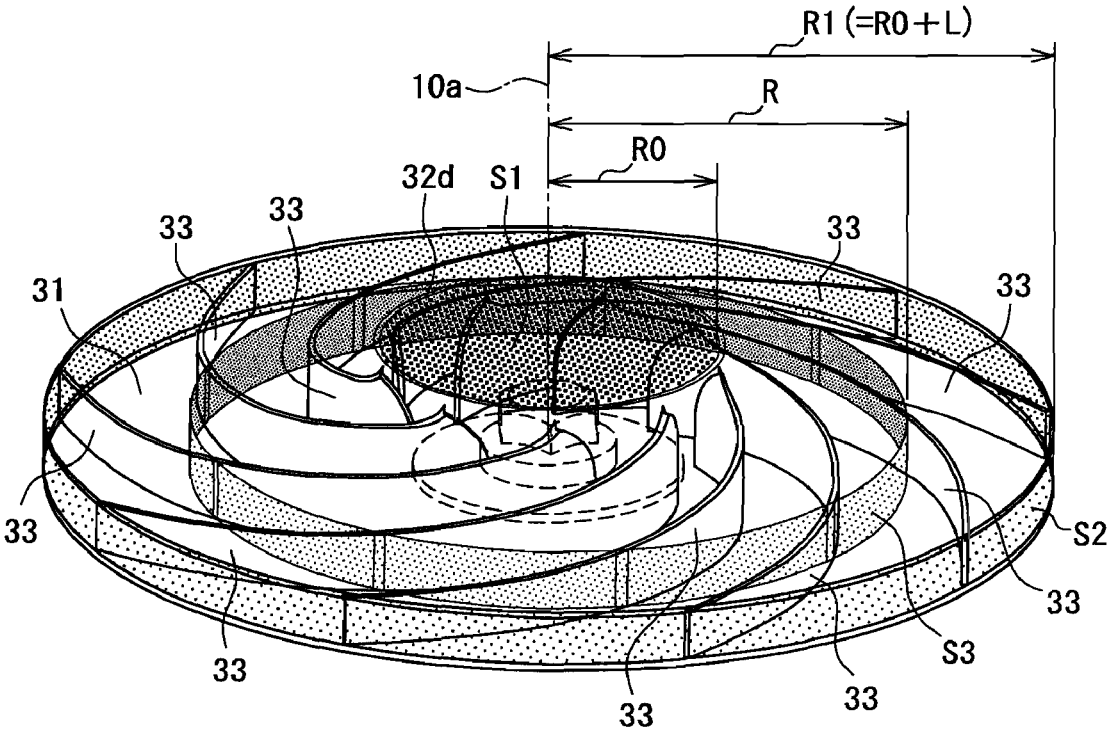
FIG. 11 is a perspective view showing flow channel areas S1, S2, and S3 of the impeller.

FIG. 11 is a perspective view showing the areas S1, S2, and S3 defined in the impeller 3. The area S1 refers to the flow channel area at the air inlet of the impeller 3, and is defined as the area of a circle whose radius is a distance R0 from the rotational axis 10*a* to the edge portion 32*d* of the central opening portion 32*a*. The area S2 refers to the flow channel area at the air outlet 39 of the impeller 3, and the radius of a virtual columnar face that defines this flow channel area is R1(=R0+L). The area S3 refers to the flow channel area inside the impeller 3, and is defined by a virtual columnar face whose radius is a distance R from the rotational axis 10*a*. Here, the radius R is a variable in which the minimum value is the radius R0 and the maximum value is the radius R1.

Figure 12:
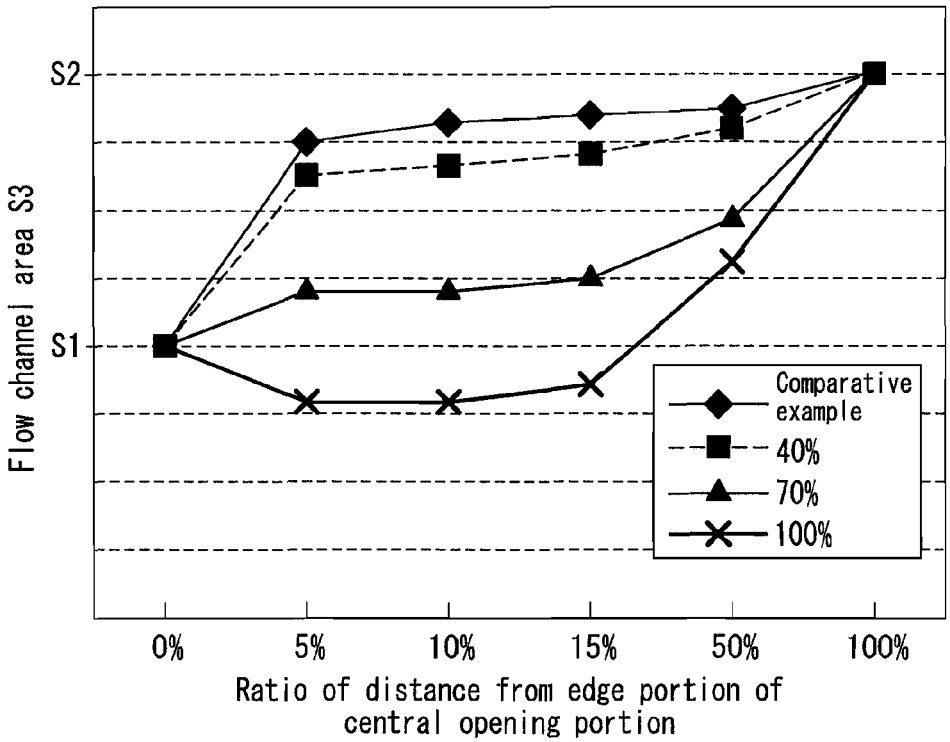
FIG. 12 is a graph showing the change in the radial direction of the flow channel area S3 inside the impeller.

FIG. 12 is a graph showing change in the radial direction of the flow channel area S3 inside the impeller 3. The horizontal axis in FIG. 12 indicates the position in the radial direction, that is, the distance from the edge portion 32*d* of the central opening portion 32*a*, as a ratio $(((R-R0)/L)\times 100(\%))$ with respect to the distance L from the edge portion 32*d* to the outer ends of the plurality of blades 33. The vertical axis in FIG. 12 indicates the flow channel area S3 at each position in the radial direction in relation to the flow channel areas S1 and S2. FIG. 12 shows change in the radial direction of the flow channel area S3, in which the sagging amount ratio ΔH/H at the point P described in FIG. 6 is varied between four values 'comparative example' (25%), 40%, 70%, and 100%.

Figure 13:
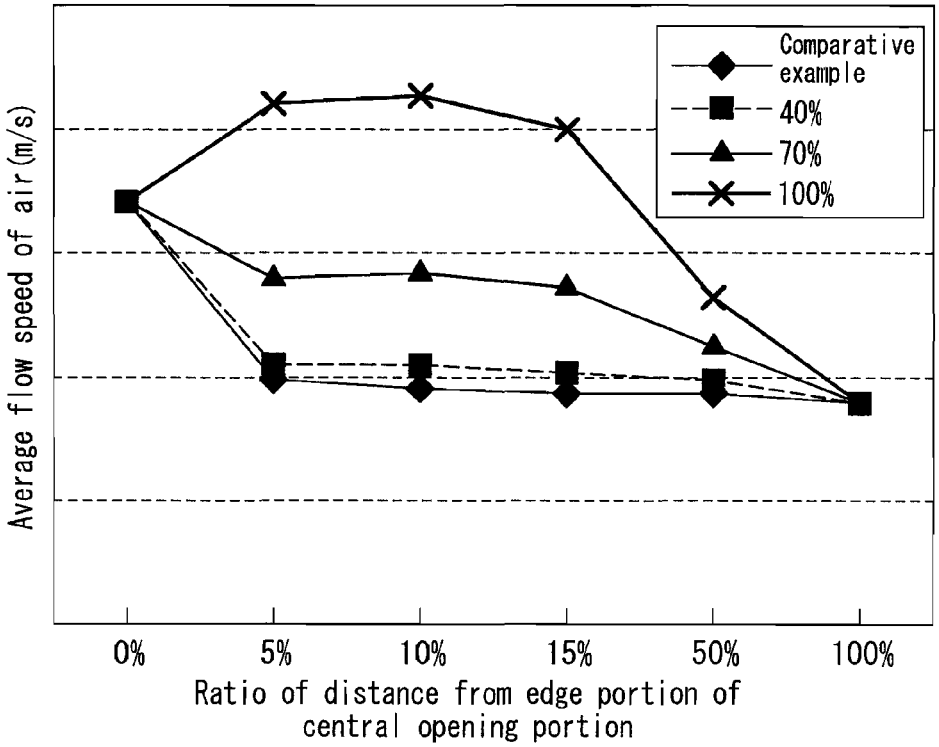
FIG. 13 is a graph showing the change in the radial direction of an average flow speed of air flows inside the impeller.

FIG. 13 is a graph showing change in the radial direction of the average flow speed of air inside the impeller 3. As in the horizontal axis in FIG. 12, the horizontal axis in FIG. 13 indicates the position in the radial direction, that is, the distance from the edge portion 32*d* of the central opening portion 32*a*, as a ratio $(((R-R0)/L)\times 100(\%))$ with respect to the distance L from the edge portion 32*d* to the outer ends of the plurality of blades 33. The vertical axis in FIG. 13 indicates the average flow speed of air inside the impeller 3 at each position in the radial direction. As in FIG. 12, FIG. 13 also shows change in the radial direction of the average flow speed of air, in which the sagging amount ratio ΔH/H at the point P described in FIG. 6 is varied between four values 'comparative example' (25%), 40%, 70%, and 100%.

If the sagging amount ratio ΔH/H at the point P is 100%, there is a portion in the impeller 3 in which the flow channel area S3 is equal to or smaller than the flow channel area S1, as shown in FIG. 12. In this case, there is a portion in the impeller 3 in which the average flow speed of the air flows is higher than that at the central opening portion 32*a*, as shown in FIG. 13.

Figure 14:
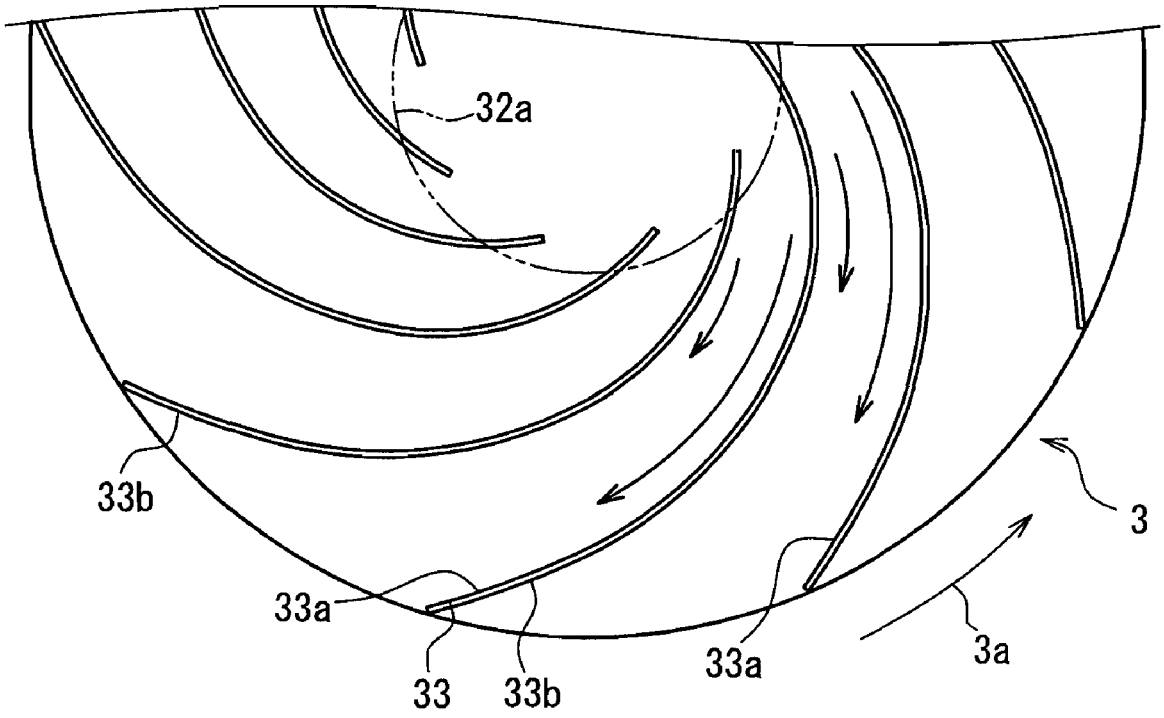
FIG. 14 is a plan cross-sectional view showing air flows inside the impeller.

The reason for this seems to be that air flows from the air inlet (central opening portion) 32*a* of the side plate 32 are suddenly accelerated and collide with each other to form a turbulent flow when passing through the portion in which the flow channel area is smaller than the flow channel area S1 at the air inlet 32*a* of the impeller 3. That is to say, as shown in FIG. 14, when air flows from the air inlet 32*a* of the side plate 32 are suddenly accelerated, the air passes through positions closer to a pressure side 33*a* of the blades 33. Thus, a difference occurs in speed between the air flow on a suction side 33*b* of the blades 33 and the air flow on the pressure side 33*a* of the blades 33, and friction between these air flows whose speeds are different from each other increases friction loss. Accordingly, if there is a portion in the impeller 3 in which the flow channel area S3 is equal to or smaller than the flow channel area S1 at the air inlet 32*a* of the impeller 3, the air blowing efficiency is lowered. Thus, the flow channel areas S1, S2, and S3 defined as described above in the impeller 3 preferably satisfy S1<S3<S2.

There is no specific limitation on the method for producing the impeller 3, and it is possible to use known production methods. For example, the main plate 31, the side plate 32, and the blades 33 having desired external shapes and curved faces may be formed separately by pressing a metal plate material having a constant thickness, and then joined to each other by caulking. With this method, a small and light impeller 3 preferably used in an electric vacuum cleaner or the like can be produced. With pressing, the cylindrical straight portion 32*c* easily can be formed in the central opening portion 32*a* of the side plate 32, and the thickness of the straight portion 32*c* is the same as or slightly smaller than that of the portions of the side plate 32 other than the straight portion 32*c*.

Figure 15:
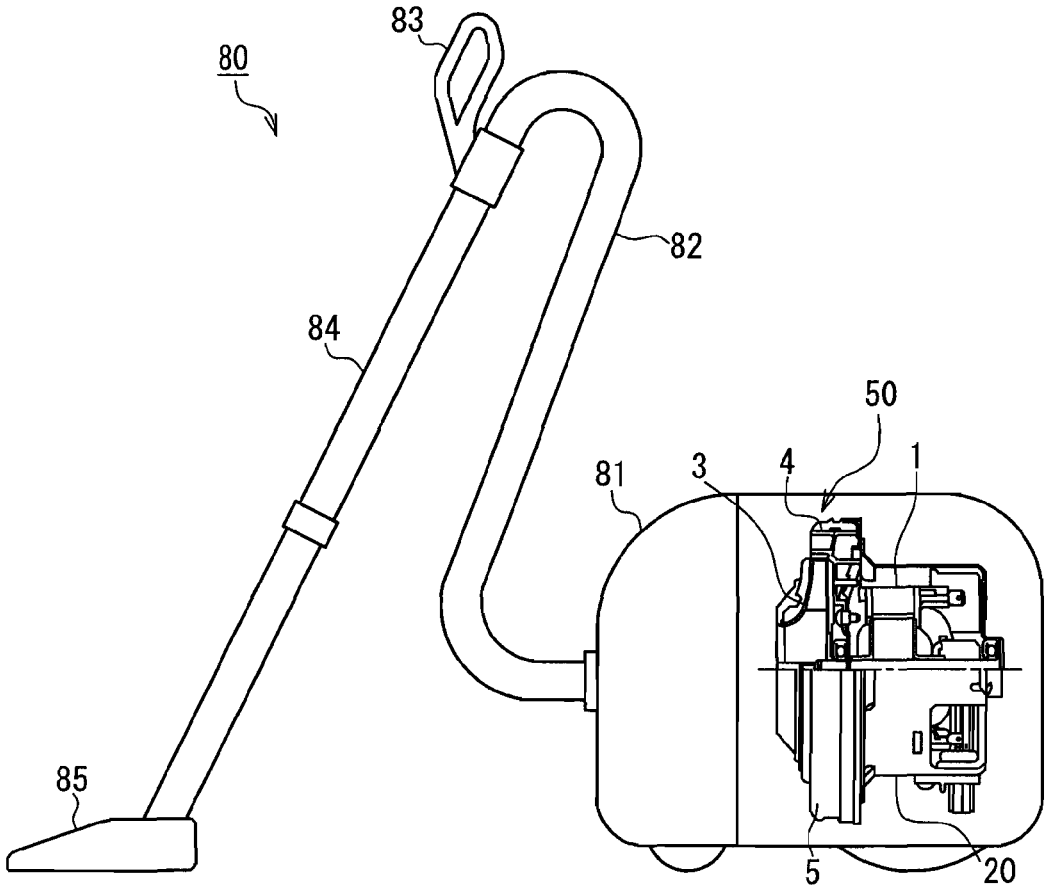
FIG. 15 is a view schematically showing a configuration of an electric vacuum cleaner according to an embodiment of the present invention.

FIG. 15 schematically shows, as an example, a configuration of an electric vacuum cleaner 80 including the electric fan 50 of the present invention. The electric fan 50 is housed in a cleaner main body 81. A flexible sucking hose 82, a handle 83 on which an operating switch and the like are provided, a connected pipe 84, and a suction port body 85 are connected in this order to the cleaner main body 81. A dust collecting portion (not shown) that separates dust from an air flow sucked from the suction port body 85 and captures the dust is provided between the electric fan 50 and the sucking hose 82. The configuration shown in FIG. 15 is merely an example, and the electric vacuum cleaner of the present invention is not limited thereto. The electric fan of the present invention can be used in any known type of electric vacuum cleaner. Through the use of the electric fan of the present invention, an electric vacuum cleaner having an excellent sucking force can be provided.

The foregoing embodiment is merely an example. The present invention is not limited thereto, and can embrace various modifications.

For example, in the foregoing embodiment, the positions of the circumferential portion 31*b* of the main plate 31, the circumferential portion 32*b* of the side plate 32, and the outer ends of the plurality of blades 33 were matched in the radial direction, but at least one of them may be different from the others.

The number or the curved face shape of the blades 33 included in the impeller 3 may be set freely.

The constituent elements in the configuration of the electric fan other than the impeller 3 are not limited to those in the foregoing embodiment, and known constituent elements may be selected and applied as appropriate according to the application of the electric fan or the like.

The application of the electric fan of the present invention is not limited to an electric vacuum cleaner, and the electric fan of the present invention can be used in various types of devices that require a fan.

The present invention can be used in various applications as an electric fan in which the air blowing efficiency is improved by reducing the formation of a vortex flow in the flow channel of air flows inside an impeller from an air inlet to an air outlet, and is effective, for example, as an electric fan used in an electric vacuum cleaner or the like.

Each of the above-described embodiments is intended merely to clarify the technical content of the present invention. The present invention is not to be construed as limited to these specific examples, but is to be construed in a broad sense, and may be practiced with various modifications within the spirit and the scope of the claims.

What is claimed is:

1. An electric fan, comprising:

a motor that has a rotor; and an impeller that includes a main plate attached to an output shaft of the rotor and having a circular circumferential portion, a side plate disposed coaxially with the main plate with a predetermined spacing therebetween, the side plate having an edge portion that defines a central opening portion that allows an air flow to flow in, and the side plate having a circular circumferential portion, and a plurality of blades arranged between the main plate and the side plate, wherein a distance between the edge portion and a central rotation axis of the output shaft measured in a direction perpendicular to the central rotation axis is equal to or smaller than a distance between the central rotation axis and any other location on the side plate measured in a direction perpendicular to the central rotation axis, wherein the side plate of the impeller is formed so that the height thereof is lowered gradually from the edge portion toward the circular circumferential portion of the side plate, and when the distance from the edge portion of the central opening portion to the circular circumferential portion of the side plate, in a direction perpendicular to the output shaft, is taken as L, the distance from the edge portion of the central opening portion to the circular circumferential portion of the side plate, in the direction of the output shaft, is taken as H, a point on the side plate away from the edge portion of the central opening portion by 0.1×L in the direction perpendicular to the output shaft is taken as P, and the distance from the edge portion of the central opening portion to the point P in the direction of the output shaft is taken as ΔH, $\Delta H/H \geqq 0.4$ is satisfied.

2. The electric fan according to claim 1, wherein the side plate comprises a cylindrical portion formed concentrically with the output shaft at the central opening portion.

3. The electric fan according to claim 1, wherein, when the total area of the central opening portion of the side plate is taken as S1, the total area of a portion between the main plate and the side plate of a virtual columnar face that passes through outer ends of the plurality of blades and whose central axis matches the output shaft is taken as S2, and the total area of a portion between the main plate and the side plate of a virtual columnar face that is formed in a range between the edge portion of the central opening portion of the side plate and the outer ends of the plurality of blades and whose central axis matches the output shaft is taken as S3, S1<S3<S2 is satisfied.

4. An electric vacuum cleaner comprising an electric fan as claimed in claim 1.

5. The electric fan according to claim 1, wherein $0.9 \geqq \Delta H/H \geqq 0.4$ is satisfied.

* * * * *